US007048255B2

(12) United States Patent
Buch et al.

(10) Patent No.: US 7,048,255 B2
(45) Date of Patent: May 23, 2006

(54) STAPLE REMOVAL TOOL

(76) Inventors: Paul M. Buch, P.O. Box 1238, Basalt, CO (US) 81621; Scotty W. Hill, P.O. Box 1238, Basalt, CO (US) 81621

( * ) Notice: Subject to any disclaimer, the term of this patent is extended or adjusted under 35 U.S.C. 154(b) by 0 days.

(21) Appl. No.: 11/042,289

(22) Filed: Jan. 24, 2005

(65) Prior Publication Data

US 2005/0161647 A1 Jul. 28, 2005

Related U.S. Application Data

(60) Provisional application No. 60/538,659, filed on Jan. 23, 2004.

(51) Int. Cl.
*B25C 11/00* (2006.01)

(52) U.S. Cl. ..... 254/28; 254/25

(58) Field of Classification Search ..... 254/28, 254/25, 131, 18; 81/436
See application file for complete search history.

(56) References Cited

U.S. PATENT DOCUMENTS

| | | | | | |
|---|---|---|---|---|---|
| 775,856 | A * | 11/1904 | Ranck, Sr. | ..... | 254/28 |
| 910,173 | A | 1/1909 | Cochran | | |
| 1,899,489 | A * | 2/1933 | Wickbergh | ..... | 81/441 |
| 2,923,335 | A * | 2/1960 | Joyce | ..... | 81/441 |
| 3,310,288 | A | 3/1967 | Berry | ..... | 254/28 |
| 3,583,673 | A | 6/1971 | Poskin | ..... | 254/28 |
| 3,698,389 | A | 10/1972 | Poskin | ..... | 254/28 |
| 4,049,236 | A | 9/1977 | Grill et al. | ..... | 254/28 |
| 5,031,881 | A | 7/1991 | Thurmston | ..... | 254/28 |
| 5,495,651 | A * | 3/1996 | Tsuha | ..... | 29/235 |
| 5,820,107 | A * | 10/1998 | Hall | ..... | 254/25 |
| 5,870,811 | A * | 2/1999 | Ciok | ..... | 29/229 |
| D465,389 | S | 11/2002 | Norton | ..... | D8/14 |
| 6,663,082 | B1 * | 12/2003 | Ploeger | ..... | 254/21 |

* cited by examiner

*Primary Examiner*—Lee D. Wilson
(74) *Attorney, Agent, or Firm*—Sheridan Ross P.C.

(57) ABSTRACT

A staple removal tool includes a working end with an enlarged area and forked portion. The forked portion includes two prongs separated by a substantially V-shaped slot, wherein the V-shaped slot includes a rounded junction. The working end tapers in thickness along two non-parallel planar surfaces that may include grooves set transversely to the longitudinal axis of the tool. A second embodiment of the staple removal tool includes a working end with both outwardly and inwardly curved exterior surfaces. The outwardly curved exterior surface leads to a prong. A blunted tine is separated from the prong by a substantially U-shaped slot that includes a rounded junction. The working end tapers along two non-parallel planar surfaces that may include grooves set transversely to the longitudinal axis of the tool. Methods of using the tools are also provided.

14 Claims, 6 Drawing Sheets

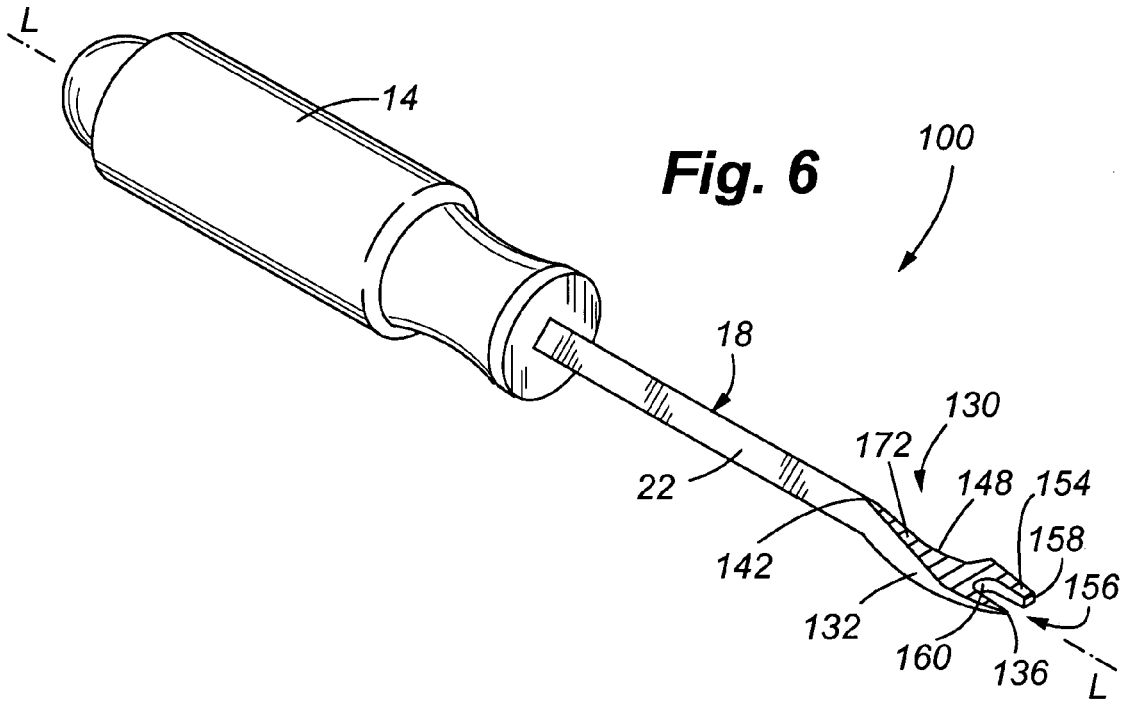
Fig. 6
Fig. 7
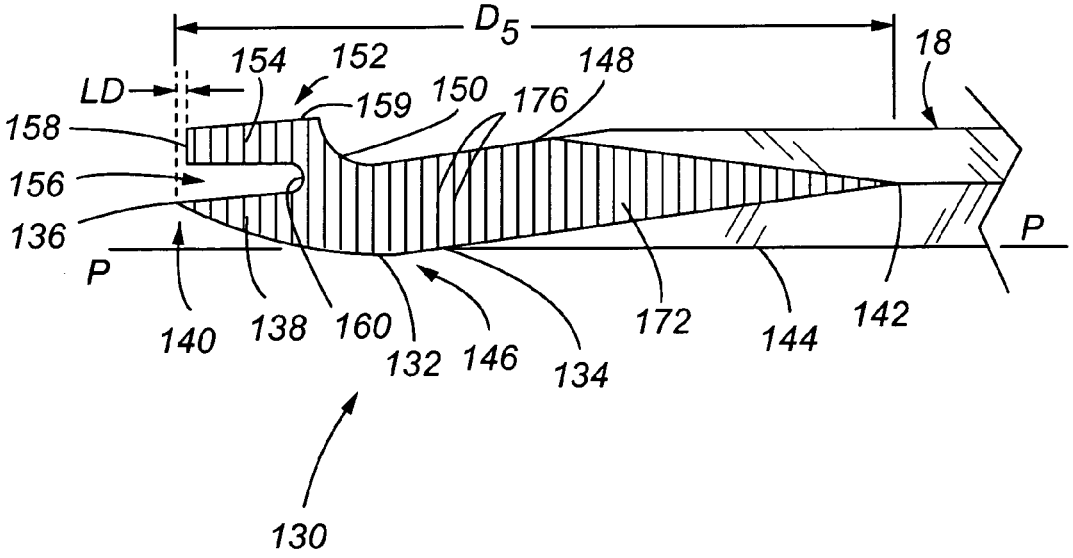

STAPLE REMOVAL TOOL

CROSS REFERENCE TO RELATED APPLICATION

The present application claims the benefit of U.S. Provisional Application No. 60/538,659 filed on Jan. 23, 2004, the entire disclosure of which is incorporated herein by reference in its entirety.

FIELD OF THE INVENTION

The present invention is directed to tools for removing staples, and more specifically, to a hand tool for removing staples from a variety of items, including upholstery and shipping containers.

BACKGROUND OF THE INVENTION

A common undertaking in the furniture restoration business is the replacement, removal and repair of upholstery on various items. Such upholstery is commonly secured in-place using staples, tacks, or other devices, which hold the upholstery to the underlying frame. While reference will generally be made herein to staples, it will be understood that the invention applies broadly to cover all securement devices, including staples and tacks. Accordingly, when the upholstery is to be replaced, removed, or repaired, it is necessary to remove at least some of the staples.

Removal of staples may be accomplished using one of a number of methods, the most common being wedging a tool beneath the staple and prying the staple from the underlying frame. For example, by using a screwdriver to wedge underneath the staple and pry it out. When removing staples in this fashion, it is common to use significant force to pry the staple from the underlying frame. This force may result in damage to the underlying frame as one end of the removal tool may scratch or dent the underlying frame. Furthermore, the upholstery may also be damaged by tearing or puncturing. If the upholstery is to be reused, it is necessary to avoid such damage. Accordingly, it would be advantageous to have a tool that can be used with less prying pressure against the underlying frame.

Another difficulty with wedging a tool between the staple and the underlying frame is the physical insertion of the tool, which may be difficult due to the staple being in close contact with both the upholstery and the frame. Previous tools are generally designed for prying up a staple. However, while these tools are designed to lift up the staple, they are not designed for easy insertion under the staple. Furthermore, the prying motion associated with using the tools requires more movement on the part of the user and is more prone to breaking the staple in its middle, leaving two pieces, and also further increases the chance of damage to the frame and fabric.

Many areas of an item to be upholstered are in tight corners or down in between finished pieces of wood. Current staple pullers are too large to fit into tight areas and are prone to damaging the item if used.

SUMMARY OF THE INVENTION

In accordance with embodiments of the present invention, a staple removal tool is provided, the tool comprising a handle, working end, and a shaft interconnected between the handle and the working end. The working end includes a forked portion having a single substantially V-shaped slot positioned between two prongs. Either prong is adapted to be inserted under a staple that is to be removed. The working end has a first width at the tips of the prongs, widens to a maximum width creating a lever arm, and narrows back to the width of the shaft. In use, after a prong of the working end is inserted under a staple, the handle may be rotated causing the working end to roll on the lever arm resulting in the staple being pulled from the material. The working end may include a grooved surface providing enhanced frictional contact between the working end and the staple.

In accordance with another embodiment of the present invention, a staple removal tool is provided comprising a handle, working end, and a shaft interconnected between the handle and working end, the working end being operable to remove staples from corners and grooves. The working end preferably includes a grooved surface providing enhanced frictional contact between the working end and the staple. The working end includes a prong operable to be inserted between a staple and a furniture piece, the working end widening from the prong and thereafter narrowing in an arc to provide a rocker arm. In use, after the prong is inserted under a staple, the handle may be rotated causing the working end to roll on the rocker arm resulting in the staple being pulled from the material.

Various embodiments of the present invention are set forth in the attached figures and in the detailed description of the invention as provided herein and as embodied by the claims. It should be understood, however, that this Summary of the Invention may not contain all of the aspects and embodiments of the present invention, is not meant to be limiting or restrictive in any manner, and that the invention as disclosed herein is and will be understood by those of ordinary skill in the art to encompass obvious improvements and modifications thereto.

Additional advantages of the present invention will become readily apparent from the following discussion, particularly when taken together with the accompanying drawings.

BRIEF DESCRIPTION OF THE DRAWINGS

FIG. 6 is a perspective view of another embodiment of the present invention;

FIG. 7 is a top plan view of the working end of the device shown in FIG. 6;

DETAILED DESCRIPTION OF THE INVENTION

Figure 1:
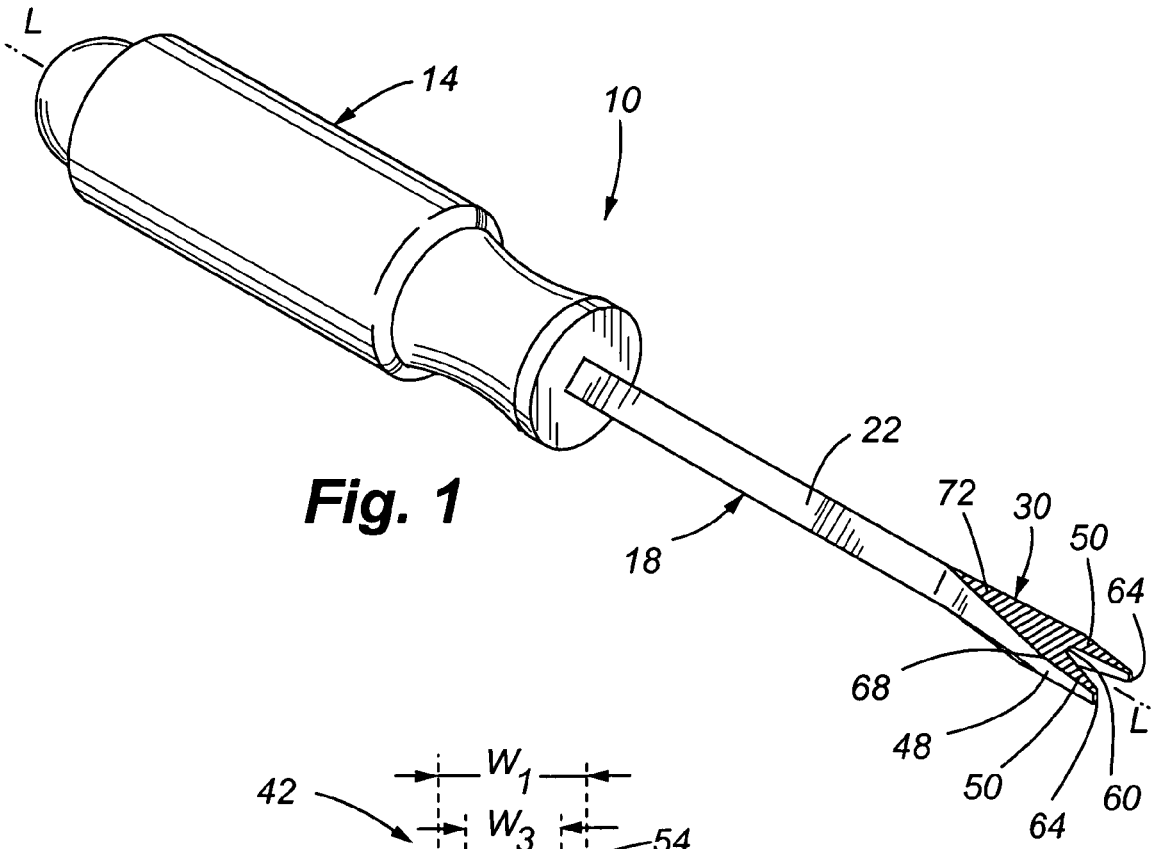
FIG. 1 is a perspective view of a tool in accordance with embodiments of the present invention.
Figure 2:
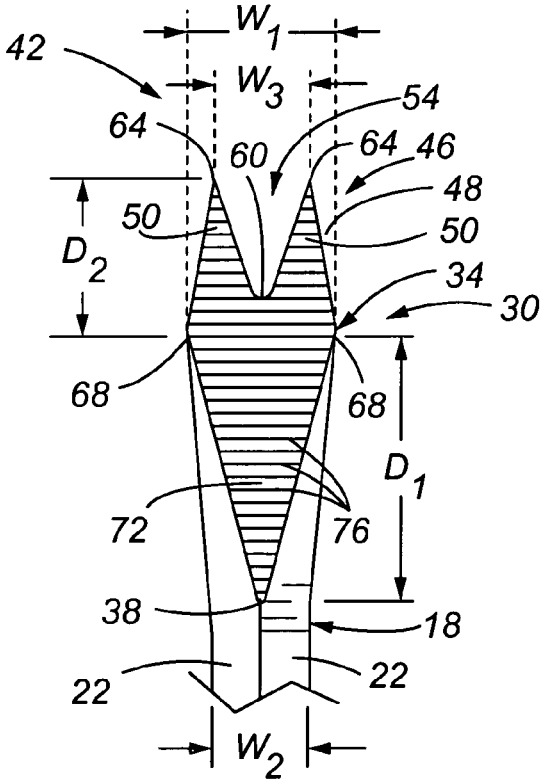
FIG. 2 is a top plan view of the working end of the device shown in FIG. 1.

The present invention overcomes the previously described problems and meets the aforementioned needs. Referring now to FIG. 1, in accordance with embodiments of the present invention, a staple removal tool 10 is shown. The tool 10 includes a handle 14. The handle 14 is configured to comfortably accommodate a user's hand while using the tool 10, while also providing enough strength to withstand normal forces applied while removing staples. In one embodiment of the present invention, handle 14 is about 4.25 inches long, has a diameter of about 1.4 inches, and is formed of hexagonal plastic. Other configurations of the handle 14 may be employed, so long as a user may grasp the tool 10 in one hand with relative ease and comfort.

The tool 10 also includes a shaft 18 that is recessed or otherwise interconnected to handle 14. In one embodiment, the shaft 18 extends about 4 inches into the handle 14, and in another embodiment the shaft 18 extends about 2 inches into the handle 14. Accordingly, the amount of the extension of the shaft 18 into handle 14 may vary, so long as the shaft 18 is securely attached to the handle 14. Furthermore, the shaft 18 may be secured to the handle 14 in a variety of fashions, such as, for example, using a friction fit, epoxy, or a threaded engagement where the shaft 18 is screwed into the handle 14. Additionally, the shaft 18 and handle 14 may be formed as an integral unit of the same material.

The shaft 18 is preferably made of steel, although other materials may be used so long as sufficient strength and durability in provided. In the embodiment illustrated, the shaft 18 is square in cross-section, with each side 22 being about 0.20 inch in width. However, the shaft 18 may have a different shaped cross-section, such as round or hexagonal.

Referring now to FIGS. 1–4, the shaft 18 includes a working end 30. The working end 30 of tool 10 includes an enlarged area 34 that is separated a first distance D1 from the proximal end 38 of the working end 30, and is separated a second distance D2 from a distal end 42 of the working end 30, where D1 is preferably greater than D2. The length of the working end 30, therefore, is the sum of D1 plus D2, and in one embodiment, the length D1 is about 1.0 inch, and the length D2 is about 0.75 inch; thus, the length of the working end 30 is about 1.75 inches. In one embodiment, the upper shaft length D3 of the shaft 18 between the proximal end 38 of the working end 30 and the handle 14 is about 2.25 inches, which provides for an appropriate lever arm to pry the staple, and also provides a reasonable length for the tool 10 to access a staple. However, other dimensions are within the scope of the invention. In addition, in one embodiment, the shaft length D4 is about 4 inches, although the shaft length D4 may vary for providing tools with shorter or longer lengths, or for different uses and tighter access conditions.

The enlarged area 34 comprises an enlarged area width W1, where the enlarged area width W1 is wider than a shaft width W2 across the largest dimension of shaft 18, and where the enlarged area width W1 is wider than a distal end width W3 of the distal end 42 of working end 30. In one embodiment, the enlarged area width W1 is about 0.47 inches wide, the shaft width W2 in its largest dimension is about 0.28 inches wide, and the distal end width W3 of distal end 42 is about 0.25 inches wide. These tool dimensions assist in accessing a staple to be removed, and in providing proper dimensions for rotating and leveraging the tool 10. While these dimensions may vary, the dimensions provided are preferred for a tool used to remove a staple from an upholstered furniture item. The device could be made proportionately smaller or larger depending upon the desired tool size and the intended use of the tool. Smaller tools could be used for tighter spaces, and larger tools for larger spaces and/or more difficult or larger staples, or for removing staples from items other than upholstered furniture, such as shipping packages.

In accordance with embodiments of the present invention, the shaft 18 and working end 30 of the tool 10 share a common longitudinal axis L—L. That is, there are no bends in the shaft 18 or working end 30. A right and left side of the tool 10 are substantially symmetrical about longitudinal axis L—L.

A forked portion 46 is located between the enlarged area 34 and the distal end 42 of working end 30. The forked portion 46 includes two prongs 50, with a single substantially V-shaped slot 54 located between the prongs 50. The single V-shaped slot 54 preferably includes a rounded junction 60. In one embodiment, the single V-shaped slot 54 is about 0.34 inches in length from the tips 64 to the rounded junction 60. In addition, in one embodiment the rounded junction 60 preferably has a radius of curvature of at least about 0.047 inches. The rounded junction 60 of the single V-shaped slot 54 is relatively open and includes, and, as noted above, includes a curved radius. Thus, the rounded junction 60 does not come to a point, and this curvature prevents a staple S from becoming wedged into the bottom of the V-shaped slot 54. The tips 64 of the prongs 50 are preferably inset relative to the outer edges 68 of the enlarged area 34. In addition, the right and left sides of the forked portion 46 preferably include substantially straight sides 48 between the outer edges 68 of the enlarged area 34 and the tips 64 of the prongs 50.

Figure 3:
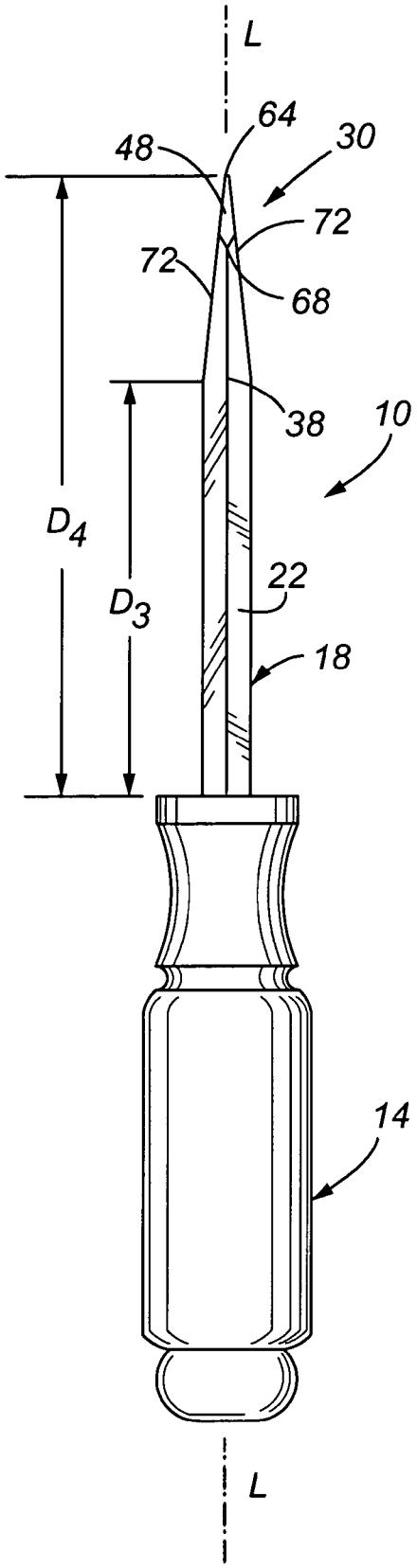
FIG. 3 is a side elevation view of the device shown in FIG. 1.
Figure 4:
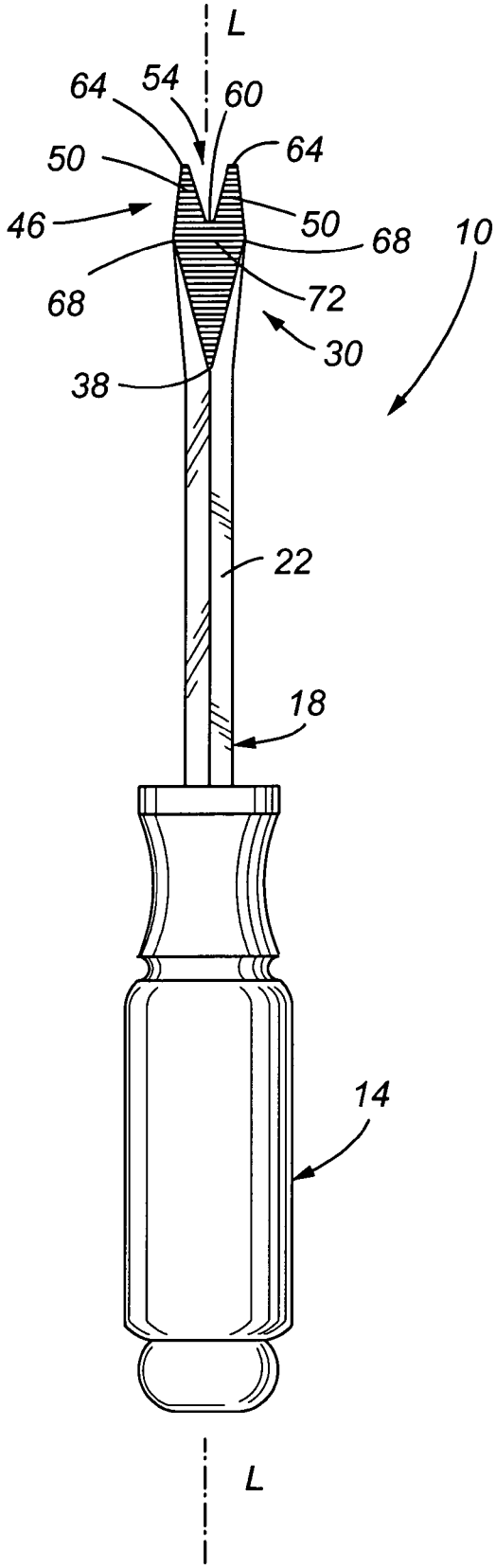
FIG. 4 is a side elevation view of the device shown in FIG. 1, the view of FIG. 4 rotated 90 degrees from the view shown in FIG. 3.

Referring now to FIGS. 3 and 4, in accordance with embodiments of the present invention, the working end 30 includes two non-parallel substantially planar surfaces 72. The planar surfaces 72 extend from the proximal end 38 of the working end 30 to the tips 64 of the prongs 50. The non-parallel planar surfaces 72 taper the thickness of the working end 30. In one embodiment, the tips 64 of the prongs 50 at the distal end 42 have a thickness of about 0.03 inches, which aids in removal of a staple. The planar surfaces 72 preferably include a texturing or grooves 76 to aid in the planar surfaces 72 frictionally interacting with a staple S to be removed. Grooves 76 are preferably oriented transverse, and more preferably, perpendicular to the longitudinal axis L—L of the tool 10. Furthermore, the entire working end 30 is preferably magnetic, although non-magnetized tools may be desired for use in packing or shipping uses in the vicinity of magnetically sensitive devices.

Figure 5:
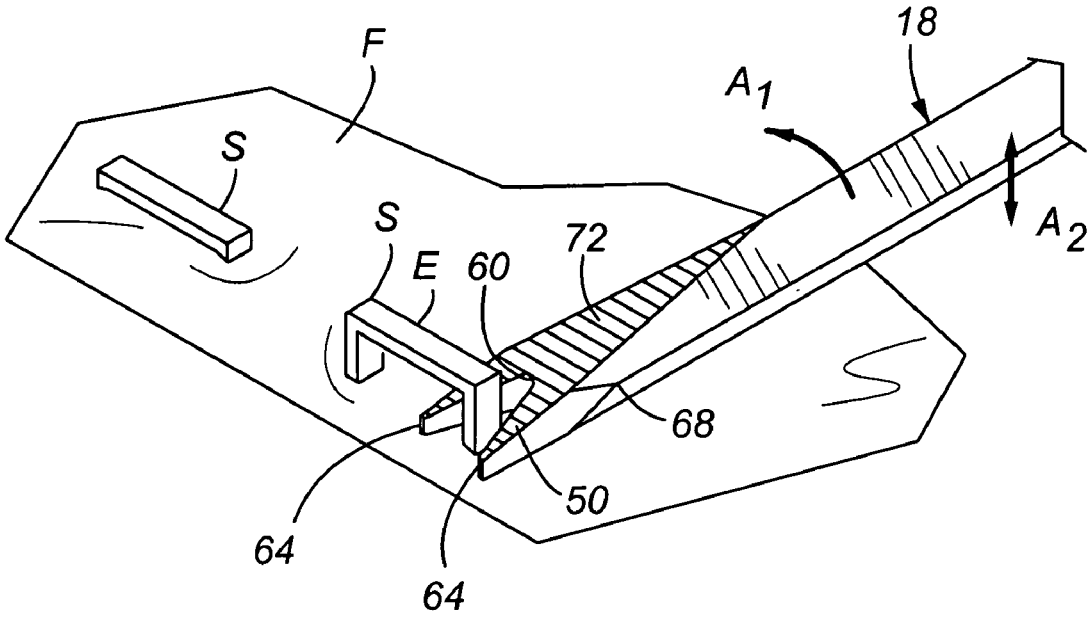
FIG. 5 is a first perspective view of the device shown in FIG. 1 being used to remove a staple.
Figure 5A:
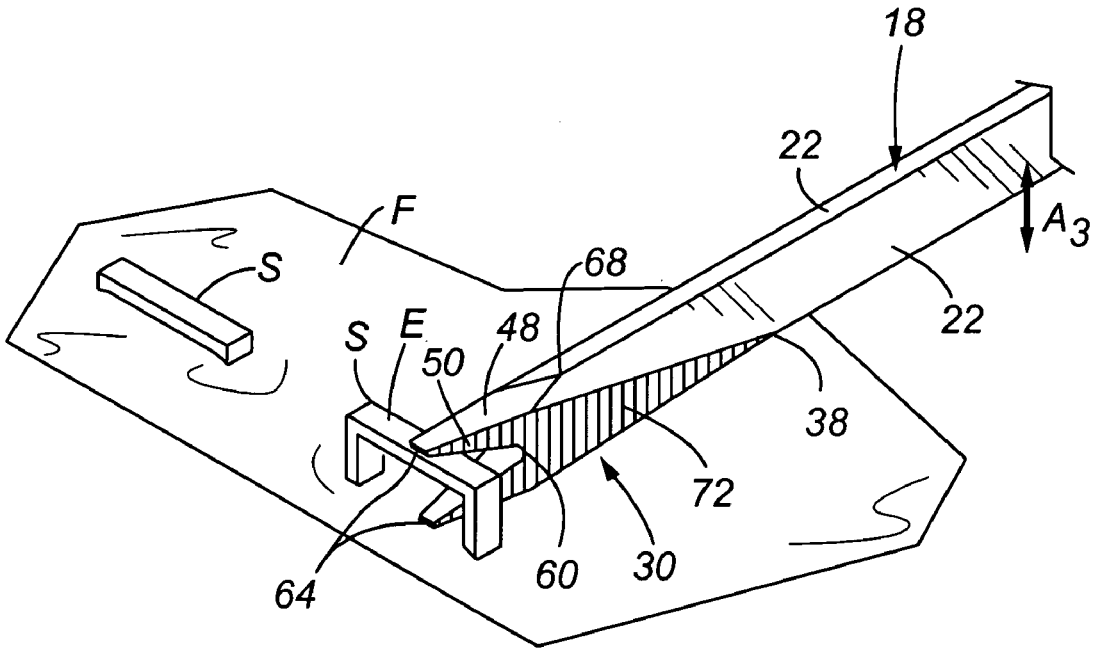
FIG. 5A is a second perspective view of the device shown in FIG. 1 being used to remove the staple.

Referring now to FIGS. 5 and 5A, in use, to remove a staple S using tool 10, a user holds the handle14, and inserts one of the prongs 50 under a staple S. The tool 10 is then rotated about its longitudinal axis L—L to loosen, pry and remove the staple S. The enlarged area 34 of the working end 30 works as a lever arm which helps provide torque with the twisting motion. The tool can also be rotated up and/or down to loosen, pry and remove the staple S. As an example of use, if the right prong 50 of the forked portion 46 is inserted between the staple S and the frame F, the user rotates the tool 10 clockwise, as per the direction of arrow A1 in FIG. 5. Similarly, if the left prong 50 is inserted, the tool 10 is rotated counter-clockwise. By rotating the tool 10 about is longitudinal axis L—L, relatively little pressure is applied to the frame F and any associated upholstery (not shown), thus reducing any damage caused to the upholstery or the frame F. The tool can also be moved up and/or down to loosen, pry and remove the staple S, as shown by arrows A2 and A3 in FIGS. 5 and 5A, respectively. As noted above, the planar surfaces 72 of working end 30 preferably include grooves 76 to help grab the staple S, and to help prevent the tool 10 from slipping relative to the staple S. More particularly, an edge E of staple S can be partially engaged by a groove 76 of the planar surfaces 72, which helps the user pry the staple using the tool 10. In addition, the magnetic surface of working end 30 helps hold the staple S, and assists in recovery of the staple S after removal.

Referring now to FIGS. 6–10, in accordance with a second embodiment of the present invention, a staple removal tool 100 is provided for removing staples, including staple extraction in tight areas and around finished wood. The tool 100 includes a handle 14 and shaft 18 as described above for tool 10. In one embodiment, the shaft length D4 is about 4 inches, although the shaft length D4 may vary for providing tools with shorter or longer lever arm lengths, or for different uses and tighter access conditions.

Referring still to FIGS. 6–10, the shaft 18 of tool 100 comprises a working end 130. In one embodiment, the length of the working end D5 is about 1.75 inches, and the upper shaft length D3 of the shaft 18 between the working end 130 and the handle 14 is about 2.25 inches, which provides for an appropriate lever arm to pry the staple, and also provides a reasonable length for the tool 100 to access a staple. However, other dimensions are within the scope of the invention.

The working end 130 includes an outwardly curved exterior surface 132. The outwardly curved exterior surface 132 curves distally from an outwardly curved exterior surface initiation point 134 to a tip 136 of a prong 138 located at the distal end 140 of the working end 130. The outwardly curved exterior surface 132 provides a rocker arm to pry a staple up after prong 138 is inserted under the staple. The outwardly curved exterior surface initiation point 134 is located distally of the proximal end 142 of the working end 130. Preferably, the outwardly curved exterior surface 132 extends or projects beyond a plane P—P of a first edge 144 of the shaft 18. The projecting portion 146 of the outwardly curved exterior surface 132 aids in providing a rocker arm to pry a staple.

The working end 130 also includes an inwardly curved exterior surface 148 that is located on a side of the working end 130 opposite the outwardly curved exterior surface 132. The inwardly curved exterior surface 148 includes a curved indentation 150 that aids the use of the tool 100 in corners or tight spaces and helps prevent damage to the frame or upholstery. The right and left sides of the tool 100 are not symmetrical about longitudinal axis L—L because of the outwardly curved exterior surface 132 and the inwardly curved exterior surface 148.

The working end 130 further includes a forked portion 152 that comprises the prong 138 as well as a blunted tine 154. The blunted tine 154 includes a blunt distal end 158. The exterior edge 159 of the blunted tine 154 is a substantially flat planar surface. To prevent scratches to an item when using the tool 100, all or a portion of the blunted tine 154 may be covered with a plastic coating or similar material if extra protection is desired when using the tool 100 around finished wood.

The blunted tine 154 is separated from the prong 138 by a single substantially U-shaped slot 156. The single U-shaped slot 156 preferably includes a rounded junction 160. In one embodiment, the single U-shaped slot 156 is about 0.34 inches in length from the tip 136 of the prong 138 to the rounded junction 160. In addition, in one embodiment the rounded junction 160 preferably has a radius of curvature of at least about 0.047 inches. The rounded junction 160 of the single U-shaped slot 156 is relatively open and does not come to a point. Accordingly, this curvature prevents a staple S from becoming wedged into the bottom of the U-shaped slot 156. In addition, the interior curved surface 162 of the U-shaped slot 156 is not sharped.

The tip 136 of the prong 138 extends longitudinally beyond the blunt distal end 158 of the blunted tine 154. The length difference LD in the longitudinal extent of the prong 138 as compared to the blunted tine 154 aids the user of the tool 100 in accessing staples in corners or tight spaces.

Figure 8:
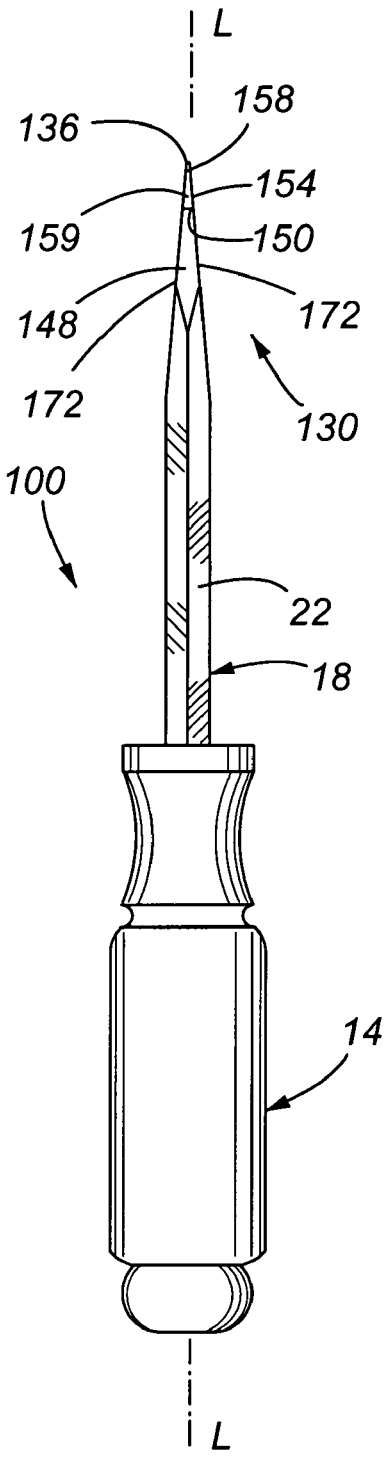
FIG. 8 is a side elevation view of the device shown in FIG. 6.
Figure 9:
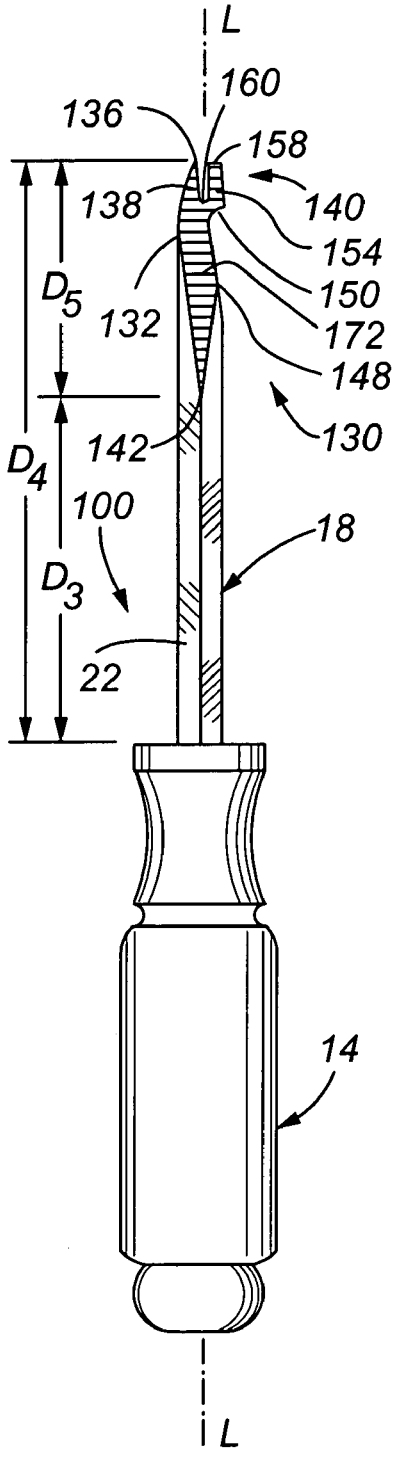
FIG. 9 is a side elevation view of the device shown in FIG. 6, the view of FIG. 9 rotated 90 degrees from the view shown in FIG. 8.
Figure 10:
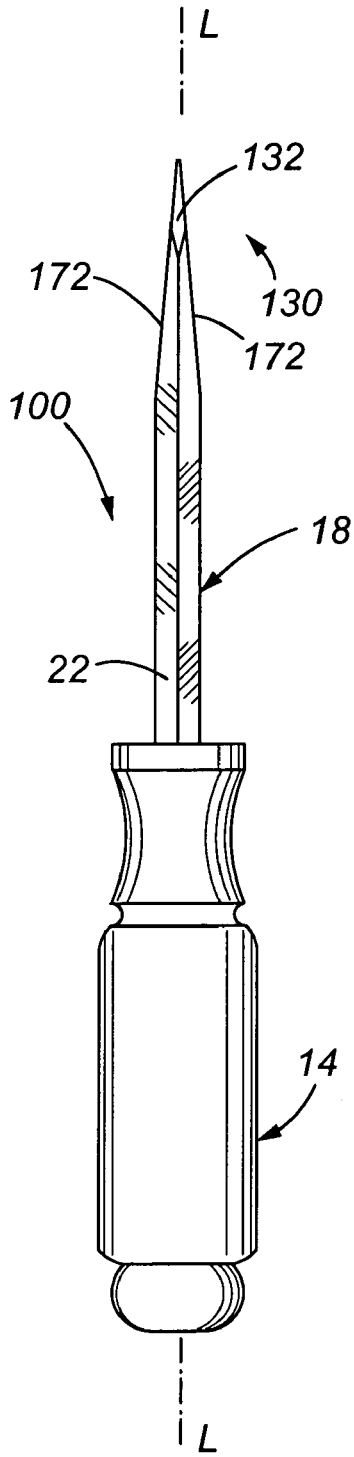
FIG. 10 is a side elevation view of the device shown in FIG. 6, the view of FIG. 10 rotated an additional 90 degrees from the view shown in FIG. 9.

Referring now to FIGS. 8–10, in accordance with embodiments of the present invention, the working end 130 includes two non-parallel substantially planar surfaces 172. The planar surfaces 172 extend from the proximal end 142 of the working end 130 to the tip 136 of prong 138, and to the distal blunt end 158 of blunted tine 154. The non-parallel planar surfaces 172 taper the thickness of the working end 130. In one embodiment, the tip 136 of the prong 138 has a thickness of about 0.03 inches, which aids in removal of a staple. The planar surfaces 172 preferably include a texturing or grooves 176 to aid in the planar surfaces 172 frictionally interacting with a staple S to be removed. Grooves 176 are preferably oriented transverse, and more preferably, perpendicular to the longitudinal axis L—L of the tool 100. Furthermore, the entire working end 130 is preferably magnetic, although non-magnetized tools may be desired for use in packing or shipping uses in the vicinity of magnetically sensitive devices.

Figure 11:
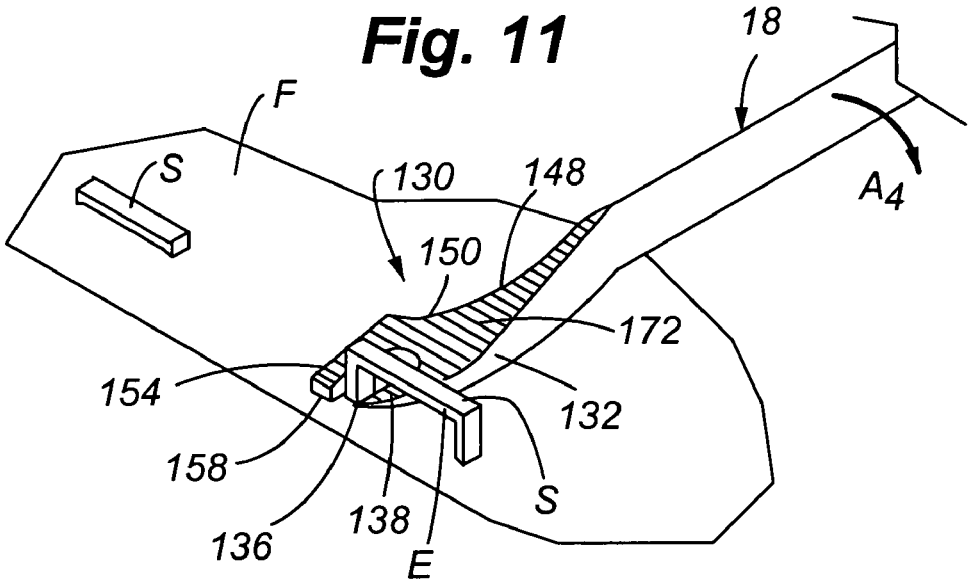
FIG. 11 is a first perspective view of the device shown in FIG. 6 being used to remove a staple.
Figure 11A:
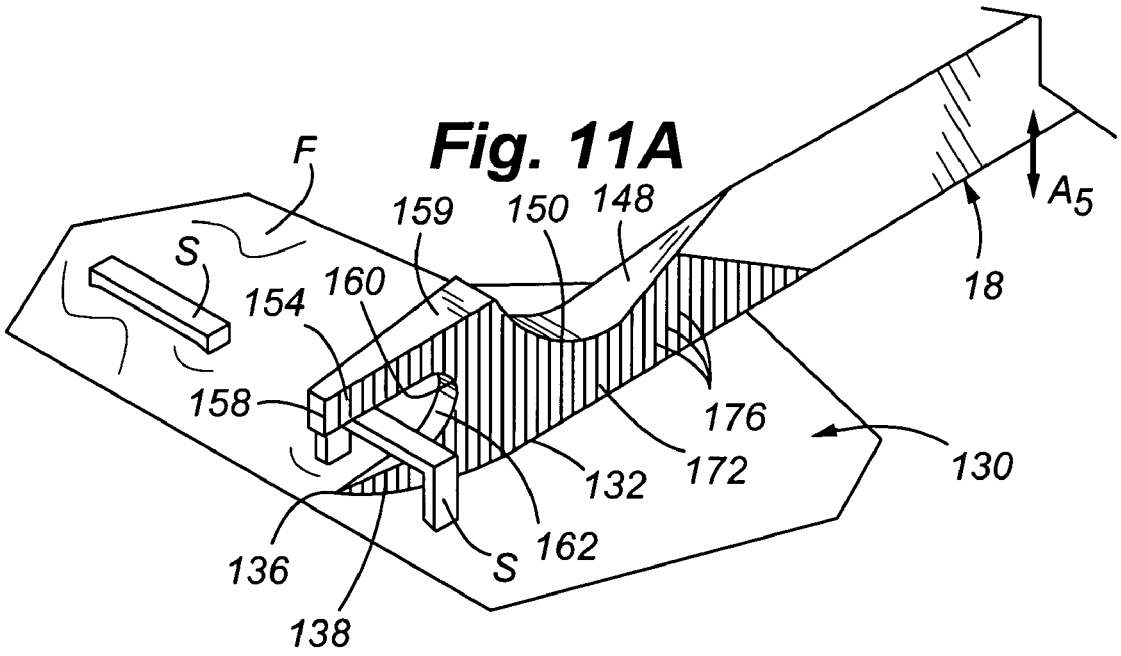
FIG. 11A is a second perspective view of the device shown in FIG. 6 being used to remove the staple.

Referring now to FIGS. 11 and 11A, in use, to remove a staple S using tool 100, a user holds the handle 14, and inserts the tip 136 of prong 138 under a staple S. The tool 100 is then rotated clockwise or counter-clockwise about its longitudinal axis L—L, as shown by arrow A4 in FIG. 11, to orient the outwardly curved exterior surface 132 against the frame F, and to loosen, pry and remove the staple S. By rotating the tool 100 about is longitudinal axis L—L, relatively little pressure is applied to the frame F and any associated upholstery (not shown), thus reducing any damage caused to the upholstery or the frame F. The outwardly curved exterior surface 132 of the working end 130 works as a lever arm which helps provide torque with the twisting motion. The tool 100 can also be moved up and/or down to loosen, pry and remove the staple S, as shown by arrow A5 in FIG. 11 A. As noted above, the planar surfaces 172 of working end 130 preferably include grooves 176 to help grab the staple S, and to help prevent the tool 100 from slipping relative to the staple S. More particularly, an edge E of staple S can be partially engaged by a groove 176 of the planar surfaces 172, which helps the user pry the staple using the tool 100. In addition, the magnetic surface of working end 130 helps hold the staple S, and assists in recovery of the staple S after removal.

As noted above, the tools described herein may be constructed proportionately smaller or larger, or have only portions of the tool modified in size depending on the dimensional constraints of the item being worked on. For example, a shorter shaft length and thus smaller tool may be desired for use in tighter areas, such as to remove staples between two closely positioned pieces of finished wood. Furthermore, the tools of the present invention have application to removing staples from shipping containers, such as pallets, crates, or cardboard boxes. Accordingly, tools modified in size for these uses are within the scope of the invention.

While an effort has been made to describe some alternatives to the preferred embodiments, other alternatives will readily come to mind to those skilled in the art. Therefore, it should be understood that the invention may be embodied in other specific forms without departing from the spirit or central characteristics thereof. The present examples and embodiments, therefore, are to be considered in all respects as illustrative and not restrictive, and the invention is not intended to be limited to the details given herein.

What is claimed is:

1. A tool for removing a staple, the tool comprising:

(a) a handle;

(b) a shaft interconnected to said handle;

(c) a working end interconnected to said shaft, said working end comprising:

(i) an outwardly curved exterior surface extending to the tip of a prong;

(ii) an inwardly curved exterior surface opposite at least a portion of said outwardly curved exterior surface;

(iii) a blunted tine located proximate said prong and distally of said inwardly curved exterior surface; and (iv) a single U-shaped slot located between said prong and said blunted tine;

wherein at least a portion of said working end is inserted under the staple to pry and remove the staple.

2. The tool as claimed in claim 1, wherein said outwardly curved exterior surface extends beyond a plane formed by an adjacent edge of said shaft.

3. The tool as claimed in claim 1, wherein said prong extends longitudinally beyond said blunted tine.

4. The tool as claimed in claim 1, wherein a proximal end of said U-shaped slot includes a rounded junction.

5. The tool as claimed in claim 1, wherein said working end includes a longitudinal axis co-axial with a longitudinal axis of said shaft.

6. The tool as claimed in claim 1, wherein an interior surface of said U-shaped slot comprises a non-sharpened surface.

7. The tool as claimed in claim 1, wherein said working end further comprises two non-parallel substantially planar surfaces extending from a proximal point of said working end to a distal end of said working end.

8. The tool as claimed in claim 7, wherein said two planar surfaces comprise grooves.

9. The tool as claimed in claim 8, wherein said grooves are oriented transverse to said longitudinal axis of said shaft.

10. A method of removing a staple from an item, comprising:

(a) providing a tool having a working end interconnected to a shaft and a handle,the working end comprising:

(i) an outwardly curved exterior surface extending to the tip of a prong;

(ii) an inwardly curved exterior surface opposite at least a portion of said outwardly curved exterior surface;

(iii) a blunted tine located proximate said prong and distally of said inwardly curved exterior surface; and (iv) a single U-shaped slot located between said prong and said blunted tine;

(b) inserting the tip of the prong under the staple;

(c) rotating the tool such that at least a portion of the outwardly curved exterior surface contacts a surface of the item; and (d) moving the handle of the tool to pry the staple from the item.

11. The tool as claimed in claim 10, wherein the prong extends longitudinally beyond the blunted tine.

12. The tool as claimed in claim 10, wherein a proximal end of the U-shaped slot includes a rounded junction.

13. The tool as claimed in claim 10, wherein the working end includes a longitudinal axis co-axial with a longitudinal axis of the shaft.

14. The tool as claimed in claim 10, wherein the working end further comprises two non-parallel substantially planar surfaces extending from a proximal point of the working end to a distal end of the working end, wherein the two planar surfaces comprise grooves,the grooves oriented transverse to a longitudinal axis of the shaft.

* * * * *